US009289905B2

(12) United States Patent
Cornell et al.

(10) Patent No.: US 9,289,905 B2
(45) Date of Patent: Mar. 22, 2016

(54) CUTTING TOOL WITH RETRACTABLE BLADES

(75) Inventors: Daniel Cornell, Los Altos, CA (US); Phillip Joseph Malvini, San Jose, CA (US); Oleh Steeyk, Kerhonhson, NY (US)

(73) Assignee: West Coast Chain Mfg. Co., Ontario, CA (US)

( * ) Notice: Subject to any disclaimer, the term of this patent is extended or adjusted under 35 U.S.C. 154(b) by 720 days.

(21) Appl. No.: 13/097,992

(22) Filed: Apr. 29, 2011

(65) Prior Publication Data

US 2011/0265618 A1 Nov. 3, 2011

Related U.S. Application Data

(60) Provisional application No. 61/330,230, filed on Apr. 30, 2010.

(51) Int. Cl.

| | |
|---|---|
| ***B26B 13/00*** | (2006.01) |
| ***B26B 11/00*** | (2006.01) |
| ***B26B 13/12*** | (2006.01) |
| ***B26B 13/16*** | (2006.01) |
| ***B26B 13/26*** | (2006.01) |

(52) U.S. Cl.

CPC ..... *B26B 13/005* (2013.01); *B26B 11/003* (2013.01); *B26B 13/12* (2013.01); *B26B 13/16* (2013.01); *B26B 13/26* (2013.01)

(58) Field of Classification Search

CPC ..... B26B 13/12; B26B 13/005; B26B 13/26; B26B 11/003; B25F 1/04

USPC ..... 30/162, 151, 152, 154, 155, 161, 145, 30/146, 175, 173, 194, 186, 239, 245

See application file for complete search history.

(56) References Cited

U.S. PATENT DOCUMENTS

| | | | | |
|---|---|---|---|---|
| 1,348,194 | A * | 8/1920 | Wescott | 452/69 |
| 2,142,738 | A * | 1/1939 | Wakeley | B26B 13/16 30/234 |
| 4,502,220 | A * | 3/1985 | Aoki | 30/154 |
| 4,715,121 | A * | 12/1987 | Sugiyama et al. | 30/253 |
| 4,791,725 | A * | 12/1988 | Amagaya | 30/154 |
| 4,794,692 | A | 1/1989 | Wang | |
| 5,357,678 | A | 10/1994 | Wei | |
| 7,377,043 | B2 * | 5/2008 | Tsai | 30/244 |

(Continued)

FOREIGN PATENT DOCUMENTS

| | | | | |
|---|---|---|---|---|
| EP | 1277550 A1 * | 1/2003 | | B26B 13/12 |
| IT | 2403001 A7 * | 4/1979 | | B26B 13/16 |

*Primary Examiner* — Kenneth E. Peterson

*Assistant Examiner* — Jennifer Swinney

(74) *Attorney, Agent, or Firm* — GSS Law Group

(57) ABSTRACT

A cutting tool includes a blade assembly with two retractable, opposing blades in a handle shaped for comfortable gripping. The blades may be closed and stowed by being partially retracted into the handle with a continuous motion of a single hand. The blades may similarly be extended and deployed for use with a continuous motion of a single hand. Each blade is formed with a shearing edge and a lever arm. Each lever arm is formed with a slot for engaging a blade locking tab joined to a cover for the handle. When the blade assembly is retracted into the handle, the shearing edges of the blades remain safely closed when the lever arms are released by a person using the tool. The cutting tool includes a retractable tether for preventing loss or damage to the tool should it be dropped.

9 Claims, 7 Drawing Sheets

(56) References Cited

U.S. PATENT DOCUMENTS

| | | | | |
|---|---|---|---|---|
| 7,755,483 | B2 * | 7/2010 | Schmidt | 340/568.1 |
| 2002/0148078 | A1 * | 10/2002 | Salentine et al. | 24/115 F |
| 2003/0061917 | A1 * | 4/2003 | Malvini | 81/300 |
| 2004/0089759 | A1 * | 5/2004 | Genuise | 242/379 |
| 2008/0110027 | A1 * | 5/2008 | Seber et al. | 30/152 |
| 2010/0243783 | A1 | 9/2010 | Hermann, II | |

* cited by examiner

Section A-A

CUTTING TOOL WITH RETRACTABLE BLADES

CROSS REFERENCE TO RELATED APPLICATIONS

This application claims the benefit of U.S. Provisional Application No. 61/330,230, filed Apr. 30, 2010, incorporated herein in its entirety.

FIELD OF THE INVENTION

The present invention relates generally to a hand tool with retractable cutting blades and more specifically to a hand tool having a pair of shearing blades that may be extended, retracted, and operated with one hand.

BACKGROUND

Small cutting tools such as scissors, snips, and clippers are useful for applications in which it is desirable to remove small amounts of material from an item being trimmed. For example, small scissors or snips may be used to trim thread used in sewing or leader line used to attach a fishing lure to a fishing line. The small size of such tools makes them easy to carry so that they are readily available when needed. However, even small cutting tools present hazards unless precautions are taken to provide protection from sharp cutting edges or pointed blade tips.

Separate carrying cases may be provided with small cutting tools to protect people and objects from contacting sharp tool edges. A case also serves to protect sharp parts of a tool from being damaged by contact with other objects. Separate tool cases are easily lost or misplaced, leaving one to carry an unprotected tool. Or one may inadvertently place a tool in the wrong case. The tool may not be held securely in a mismatched case or protection from the tool may be inadequate.

Some tools are provided with features to lessen the risk of contact with sharp edges or pointed tips. Scissors may be provided with rounded blade tips. Unfortunately, rounded blade tips may make the scissors less useful for precise cutting and trimming. Some clippers or trimmers have opposing blades that are spaced closely enough together to make it difficult for an object to inadvertently get between the blades. However, such close spacing, and even the shape of the blades themselves, may make it difficult to position the tool for precise trimming or for removing material very close to a part of an object that is preferably not to be cut. For example, one may wish to trim the end of a string or thread projecting from a knot without cutting into the knot itself. Other cutting tools may fold in such a way as to protect sharp or pointed parts when blades on the tool are placed in a stowed position. It may be difficult to open such a tool one-handed. For example, a fisherman may find it challenging to hold a fishing rod, fishing lure, leader line, and folding scissors all at the same time while attempting to open the scissors and trim the line.

What is needed is a system is a cutting tool that may safely be carried in stowed position without the need for a separate carrying case. What is further needed is a cutting tool that is suitable for making small, precisely placed cuts. What is also needed is a cutting tool that may be easily operated and opened and closed with one hand.

SUMMARY

Embodiments of the invention comprise a cutting tool having a handle formed with a cavity into which a blade assembly comprising an upper blade and a lower blade may be retracted. The cutting tool includes a blade lock for holding the blade assembly closed when the blade assembly is retracted into the handle. Each of the upper blade and lower blade include a lever arm and a finger grip. When the blade assembly is retracted, the lever arms retract into a void formed in the handle and the finger grips conform closely to the sides of the handle. When the blade assembly is extended from the handle, the cutting edges of the blades are extended and a spring opens the blades automatically. In some embodiments of the cutting tool, a fastener for coupling the upper blade to the lower blade has a protruding end which engages a channel formed in the handle to guide the blade assembly smoothly into or out of the handle. In other embodiments of the cutting tool, the upper and lower blades are formed with oblong slots which slide over a pin joined to a surface of a cavity within the handle. When the blade assembly is retracted into the handle, the shearing edges of the blades cover one another, thereby protecting the sharp edges of the tool from damage and protecting other objects and persons from damage or injury from the sharp edges.

Arcuate finger grips on the lever arms contact the long sides of the handle when the blade assembly is retracted into the handle. Moving the finger grips toward the handle front side extends the shearing edges of the blade assembly from the handle front side. Keeping the finger grips close to the sides of the handle when the blade assembly is retracted makes it more difficult for the blades to be extended accidentally.

In some embodiments of a cutting tool, a blade lock includes a blade locking tab joined to the handle cover. Each of the lever arms may be formed with a blade locking slot having a size selected for a sliding fit over the blade locking tab. Compressing the finger grips toward one another and moving the finger grips toward the back side of the handle causes the blade locking slots to align with one another and slidably engage with the blade locking tab. The spring which opens blades for cutting also holds the lever arms against the blade locking tab when the blade assembly is retracted, thereby holding the cutting tool safely closed.

Embodiments of the invention further include an automatically retracting tether extendable from the back side of the handle. A cutting tool also includes at least one light emitting diode positioned to emit light from the front side of the handle toward the shearing edges of the blade assembly. A battery compartment with a cover is provided in the handle for holding electrical storage batteries for providing power to the light emitting diode. A slide switch actuator is provided on the top side of the handle for selectively turning the light emitting diode on or off.

Another embodiment of the invention comprises a method for stowing retractable blades in a tool handle. The method embodiment of the invention includes compressing a first finger grip on a first lever arm for a first retractable blade toward a second finger grip on a second lever arm for a second retractable blade rotatably coupled to the first retractable blade. While compressing the first finger grip toward the second finger grip, the finger grips are pulled together toward the back side of the tool handle. The finger grips are compressed toward one another and pulled toward the back side of the tool handle until slots in the lever arm for each retractable blade slidably engage a blade locking tab in the tool handle.

This section summarizes some features of the present invention. These and other features, aspects, and advantages of the embodiments of the invention will become better understood with regard to the following description and upon reference to the following drawings.

DESCRIPTION

Figure 1:
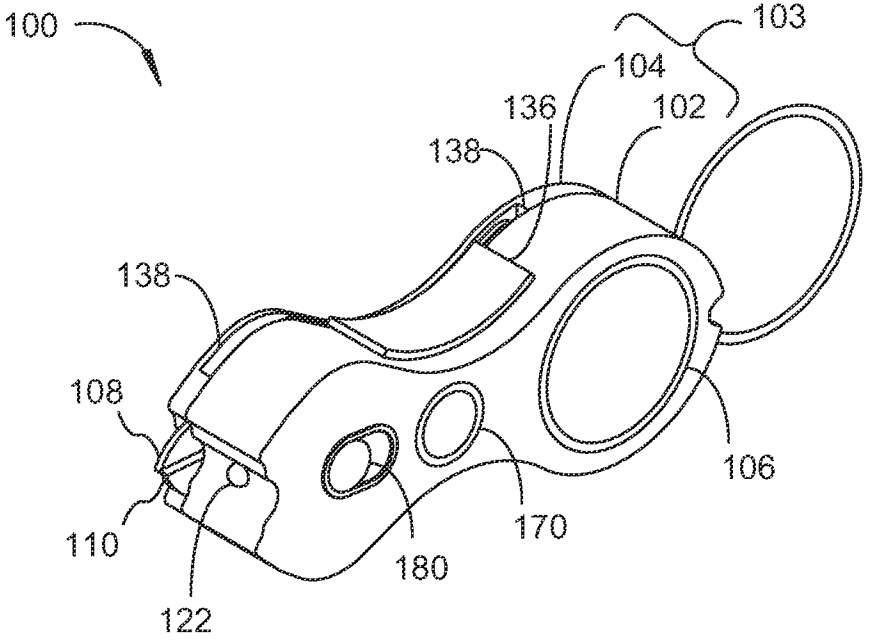
FIG. 1 is a pictorial view of an example of a cutting tool with retractable blades, showing the blades and lever arms retracted into the handle of the tool.

An embodiment of the invention comprises a cutting tool with a blade assembly that is retractable into the tool's handle, a battery-operated light for illuminating an object to be trimmed, and a tether reel with an automatically retracting tether. A cutting tool in accord with an embodiment of the invention is well suited for precisely removing selected amounts of material from an object being cut. For example, the cutting tool is advantageous for trimming line ends from knots in fishing line or from knots used in sewing, especially when the knots are small and ambient lighting is insufficient for close work.

The blade assembly includes two blades with opposing shearing edges which may be moved toward one another to cut another object by pressing lever arms for each of the blades toward one another. In one example of a cutting tool, an upper blade and lever arm and a lower blade and lever arm are rotatably joined together by a fastener with fastener ends that protrude outward from opposite sides of the blade assembly. Examples of a fastener include, but are not limited to, a rivet, a roll pin, and a threaded fastener comprising a bolt and nut. In another example of a cutting tool, a pin or post is attached to or formed as an integral part of the tool's handle, and the upper and lower blades are formed with oblong apertures that fit over and slide along the pin or post. The upper and lower blades may optionally be arranged to move toward one another without a relative rotational motion between the blades, for example by coupling the shearing edge of each blade to its associated lever arm with a mechanical linkage for providing linear blade motion. One of the protruding fastener ends in the blade assembly slides within a guide channel in the handle so that the blade assembly may be retracted into the handle with the blades closed or extended from the handle with the blades opened for cutting.

The blade assembly includes a blade lock for holding the blades closed when the blade assembly is retracted into the handle. In one embodiment of a cutting tool, a blade locking slot in each lever arm engages a blade locking tab in the handle when the blade assembly is retracted, thereby holding the blades safely closed with their shearing edges protected from contact with other objects. In another embodiment of a cutting tool, the tapered ends of the lever arms in the blade assembly slidably engage the back edges of apertures formed in the sides of the tool handle, thereby forcing the blades closed as the blade assembly is retracted into the handle and holding the blades closed while they are retracted.

To use the cutting tool, the blade assembly is slid forward so that the shearing edges of the blades are exposed outside the handle and the blade locking slots in the lever arms disengaged from the blade locking tab in the handle. Extending the blades from the handle improves the visibility of the shearing edges relative to an object being trimmed, making it easy to precisely locate a cut. The blades and shearing edges have shapes which enable the cutting tool to cut selected parts of an object without cutting other parts of the object. An electrical circuit comprising a light-emitting diode (LED) in series electrical connection with a single-pole single-throw slide switch and at least one electrical storage battery, for example a coin cell, is provided for illuminating an object to be trimmed.

FIGS. 1-10 show an example of a cutting tool with retractable blades in accord with an embodiment of the invention. FIG. 1 is a pictorial representation of a cutting tool 100 viewed toward the front, top, and one long side of a handle 103. In the example of FIG. 1, the lower blade 108 and upper blade 110 are retracted into an interior cavity in the handle 103 and a finger grip 136 for the upper blade 110 is shown in its stowed position against the handle 103. The arcuate shape of the fingers grips 136 matches the arcuate shape of the left and right sides of the handle 103 so that the finger grips conform to the sides of the handle when the blade assembly is retracted. The handle 103 may be machined or cast from a strong, easily formed material such as metal, plastic, wood, or a composite material. The lever arms and other parts of the blade assembly are withdrawn into the handle 103 through slots formed in the long sides of the handle. One of the slots in a long side of the handle 103 is represented in FIG. 1 by slot edges 138.

In some embodiments, for example the cutting tool 100 of FIG. 1, the handle 103 is divided into a handle housing 102 and a handle cover 104. Although the examples illustrated in the figures herein show a handle cover on a bottom side of the handle housing, it will be appreciated that several different embodiments of the invention may be made by dividing the handle into two or more sections that are shaped differently than as suggested in FIG. 1. For example, a removable cover could be attachable to a side of the handle or to an end of the handle, instead of to the bottom of the handle as shown in FIG. 1.

An LED 122 is positioned to emit light from the front side of the handle housing 102. A cutting tool 100 may optionally be provided with more than one LED. A switch actuator 180 is slidably coupled to the top side of the handle housing 102 for turning the LED 122 on and off. The switch actuator 180 may optionally be used to control an intensity of illumination from the LED 122. A battery compartment cap 170 covers a storage compartment for holding one or more electrical storage batteries for providing power to the LED 122. A tether reel cap 106 provides access to an interior cavity in the handle housing 102. The tether reel cap 106 optionally covers a storage compartment for a battery for providing power to the LED 122. In some embodiments of a handle 103, the tether reel cap 106 is formed as an integral part of the handle housing 102.

Figure 2:
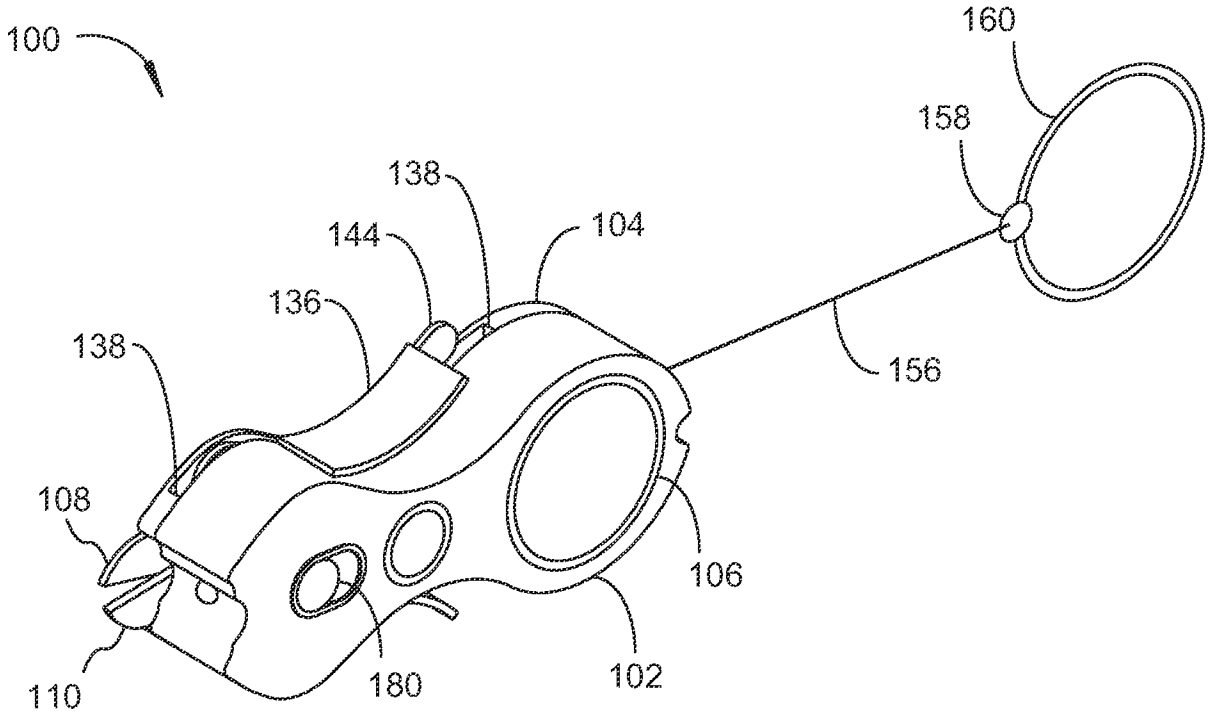
FIG. 2 is a pictorial view of the cutting tool of FIG. 1 with retractable blades, lever arms, and finger grips fully extended from the handle and ready for use, and further showing a an automatically retracting tether with a key ring partially withdrawn from the back side of the cutting tool.

FIG. 2 illustrates the cutting tool 100 of FIG. 1 with the blade assembly deployed for use. In FIG. 2, the upper blade 110 and the lower blade 108 are fully extended from the handle housing 102, projecting forward from the front side of the handle with the shearing edges of the blades separated from one another. FIG. 2 also shows a tether 156 partially withdrawn from the back side of the handle housing 102. A line stop 158 and key ring 160 are attached to the outer end of the tether 156. The tether 156 is made from a thin, flexible line or cord and is wound around a tether reel inside the handle 103. The key ring 160 may be attached to an article of clothing worn by the cutting tool's user or to another secure object to prevent the tool being lost or damaged should the user drop it. In one example, a tether 156 may be extended from the tool by approximately three feet. The tether 156 retracts the up to the line stop 158 automatically when the user releases the cutting tool 100.

Figure 4:
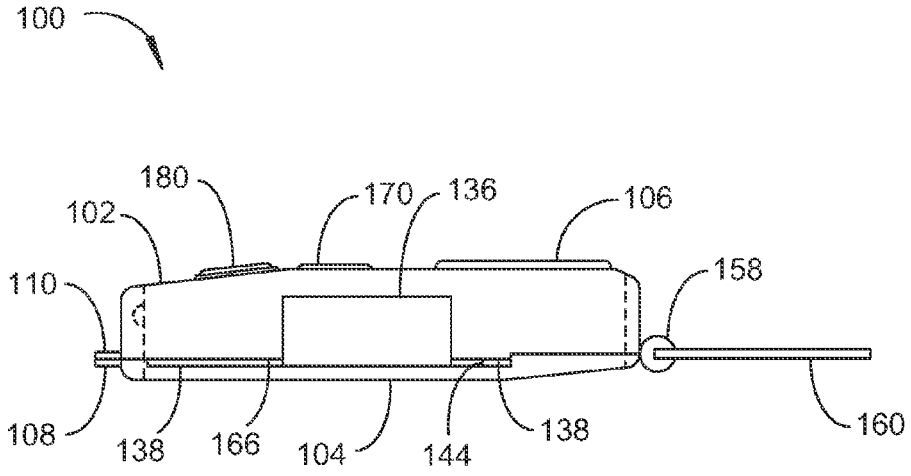
FIG. 4 is a side view of the cutting tool of FIGS. 1-3, showing retracted blades on a front side of the handle, the tether on the back side of the handle, one of two finger grips on a longest side of the handle, and a handle cover on the bottom side of the handle.
Figure 5:
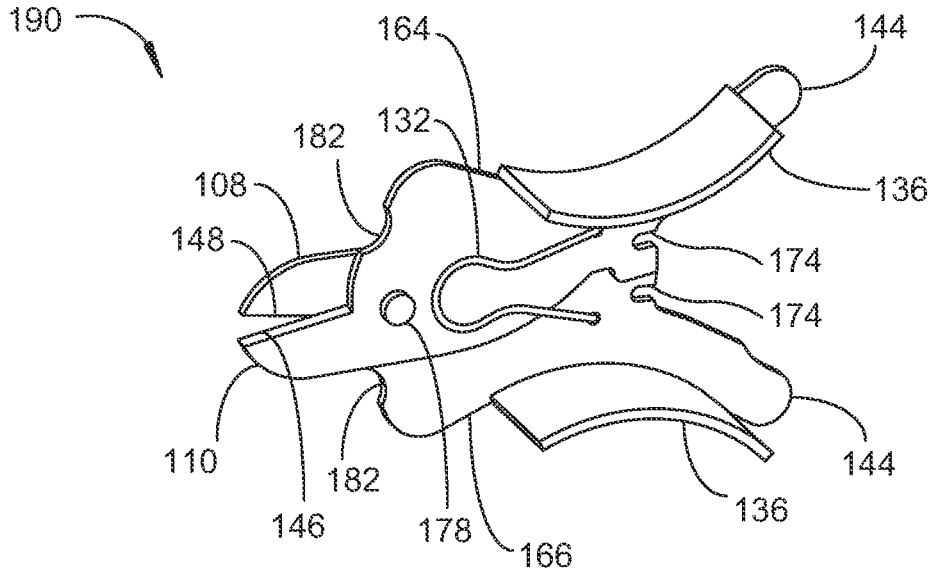
FIG. 5 is a pictorial view toward the top side of an example of a blade assembly, showing an upper blade joined to a lower blade by a fastener, a blade spring for forcing the shearing edges and lever arms of the upper and lower blades apart, and blade locking slots on the lever arms of each of the upper and lower blades, with the shearing edges of the upper and lower blades separated for cutting another object.
Figure 9:
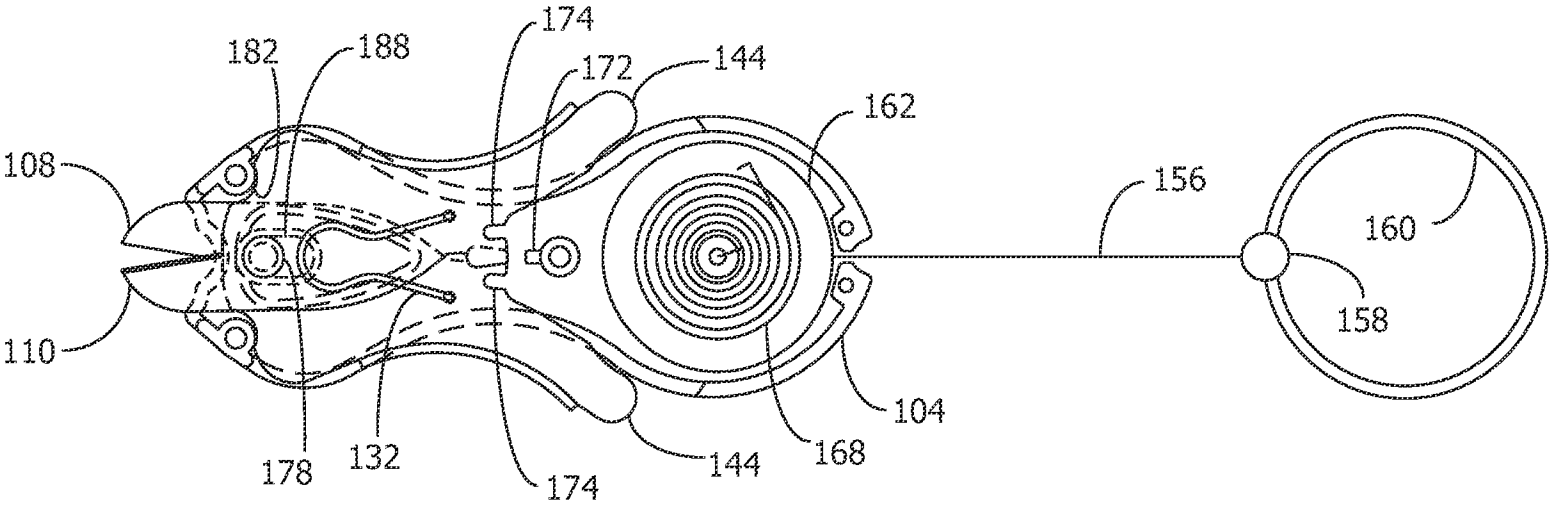
FIG. 9 is a top view of the cutting tool with the handle removed, blades extended outward from the front side of the handle and opened for cutting, finger grips and lever arms extended away from the sides of the tool cover, and the tether and key ring extending from the back of the cutting tool.

The blades of the cutting tool 100 are considered to be closed when the shearing edges of the blades are in contact with each other over essentially the entire length of the shearing edges, or when the shearing edge of one of the blades is rotated past the shearing edge of the other blade so that the blades can not be used for cutting by shearing an object between the blades. The blades are considered to be retracted into the handle when the blades are closed and the shearing edges of the blades are at least partially, or alternatively fully, covered by the handle. FIGS. 1, 3, 6, and 10 show examples of closed blades. FIGS. 2, 5, and 9 show examples of open blades. FIGS. 1, 3, 4, and 10 show examples of retracted blades and of a retracted blade assembly. FIGS. 2 and 9 show examples of extended blades and of an extended blade assembly.

Continuing with FIG. 2, the tapered end 144 of the lever arm for the upper blade 110, along with its associated finger grip 136, extends outward and away from the long sides of the handle housing 102, projecting through a slot represented by slot edges 138 in the handle housing 102 and handle cover 104. Part of a finger grip 136 associated with the lower blade 108 is also visible in FIG. 2. The handle cover 104 may be removably attached to the bottom side of the handle housing 102 by threaded fasteners (not illustrated). Alternatively, the handle cover 104 may be attached to the handle housing 102 by adhesive or by welding. With the blade assembly fully extended as shown in FIG. 2, the upper blade 110 and lower blade 108 may be forced together for cutting an object by squeezing the two finger grips 136 toward one another.

Figure 3:
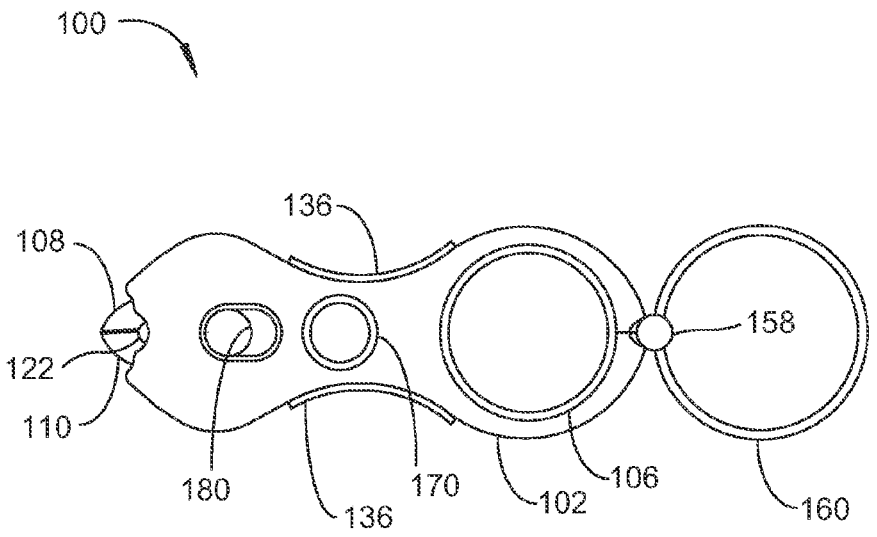
FIG. 3 is a top view of the cutting tool of FIG. 1 and FIG. 2 with retractable blades, finger grips, and the tether in their stowed positions relative to the handle, and further showing a switch activator, a battery cover, and a tether reel cap on the top side of the handle.

FIG. 3 shows a view toward the top side of the cutting tool 100 of FIG. 2. FIG. 4 shows a view toward the left side of the cutting tool 100. In FIGS. 3-4, the upper and lower blades (110, 108) are shown in their stowed or retracted position, as in FIG. 1. FIG. 3 shows both finger grips 136 stowed against the handle housing 102. A line stop 158 attached to a key ring 160 prevents the cutting tool's tether (see ref. no. 156 in FIG. 2) from being withdrawn beyond reach inside the handle housing 102. A finger grip 136 is shown from the side in FIG. 4. The lever arm to which the finger grip is attached slides into and out of the handle housing 102 and handle cover 104 through a slot represented by slot edges 138. There is one slot on the left side of the handle and another slot on the right side of the handle, offset vertically from one another by the thickness dimension of a blade.

Figure 6:
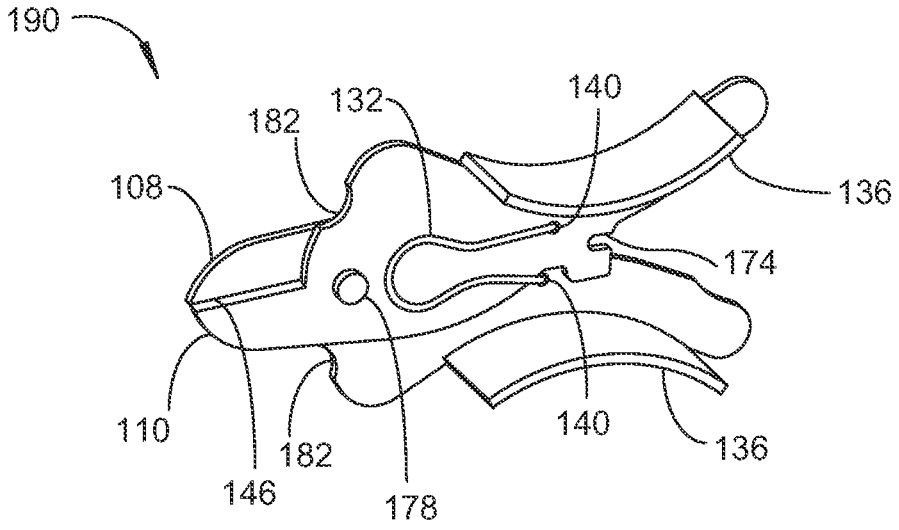
FIG. 6 is a pictorial view of the blade assembly of FIG. 5, with the upper and lower blades shown in a closed position and further illustrating the blade locking slots aligned with one another so as to engage a blade locking tab on the handle cover.

FIGS. 5-6 show an example of a blade assembly 190 for use with a cutting tool embodiment of the invention. A blade assembly 190 comprises an upper blade 110 rotatably joined to a lower blade 108. The upper blade 110 comprises an upper shearing edge 146, an upper blade lever arm 164, a lever arm tapered end 144, and a finger grip 136. The lower blade 108 comprises a lower shearing edge 148, a lower blade lever arm 166, a lever arm tapered end 144, and a finger grip 136. The upper blade 110 may alternatively be fabricated as a single integral part comprising the upper shearing edge 146, the upper blade lever arm 164, the lever arm tapered end 144, and the finger grip 136, or some of these parts may be formed separately and joined together to form the upper blade 110. The lower blade 108 may similarly be formed as an integral part or as separate parts joined together. The shearing edge 146 on the upper blade 110 may be formed with a straight cutting edge as shown in FIG. 5 or may be formed with a serrated edge. The shearing edge 148 on the lower blade 108 may also be formed with a straight cutting edge or with a serrated edge. A serrated edge on one or both of the upper blade 110 and lower blade 108 is preferred for cutting monofilament fishing line and other lines made from synthetic materials. The upper and lower blades may be formed from a material capable of holding a sharp cutting edge, such as tool steel or ceramic. Alternately, the lever arms of the blades may be formed from one material and the shearing edges of the blades may be formed from another material capable of holding a sharp cutting edge.

As shown in the view toward the top side of a blade assembly in FIGS. 5-6, the upper blade 110 is rotatably joined to the lower blade 108 by a fastener with protruding ends. A fastener 178 with a protruding end is shown at the rotatable joint between the upper blade 110 and lower blade 108 in FIGS. 2-3. The fastener 178 passes through aligned apertures (not visible) formed in the upper blade 110 and lower blade 108. The opposite end of the fastener 178 may optionally protrude from the right side of the lower blade 108 (back side not visible in the figures). The end of the fastener 178 protrudes above the surface of the blade far enough to slidably engage with a guide channel in the handle without the end of the fastener slipping out of the guide channel. A blade spring 132 having a first end which passes through a spring retention aperture 140 in the upper blade 110 and a second end which passes through another spring retention aperture 140 in the lower blade 108 exerts a force to drive the lever arms apart and separate the shearing edges on the blades. In the example of FIGS. 5-6, the blade spring 132 rests against the top side of the upper blade 110. Pressing the two finger grips 136 toward one another with sufficient force to overcome the blade spring 132 causes the shearing edges to move toward one another. In the example of a cutting tool shown in the figures herein, the blade spring 132 is a torsion spring. Many alternative shapes and locations for a blade spring may optionally be used to cause the blade assembly 190 to open and close as described.

Each of the lower blade 108 and upper blade 110 is formed with a blade limit notch 182 as shown in FIGS. 5-6. Each blade limit notch 182 is positioned to contact a selected part of the handle when the blade assembly 190 is opened. The extent to which the blade assembly 190 may be opened is determined by the depth of the blade limit notches 182. The more deeply the notch 182 is cut into the lever arm of each blade, the more the upper and lower shearing edges (146, 144) on the upper and lower blades (110, 108) may be opened when the blade assembly has been extended from the handle.

The blade assembly 190 and handle includes a blade lock to prevent the blades opening while retracted into the handle. In the example of FIGS. 5-6, each of the lower blade 108 and upper blade 110 is formed with a blade locking slot 174 along a back edge of the lever arm (164, 166) for each blade. When the blades are open as in FIG. 5, the two blade locking slots 174 are separated from one another. When the blades are closed as in FIG. 6, the two blade locking slots 174 align with one another to form a single lateral slot through the blade assembly 190. An object placed in the aligned blade locking slots 174, for example a tab, pin, or post extending from an internal part of the handle, will prevent the upper and lower blades from opening. The force exerted by the blade spring 132 causes the sides of the blade locking slots 174 to grip an object placed in the aligned slots. When the blade assembly is moved so that the blades extend from the handle and the tab is removed from the aligned blade locking slots 174, the upper and lower lever arms are free to separate and will be driven apart by the blade spring. The blades therefore reopen automatically after each cut and are held firmly closed for safety and to protect the blades when the blade assembly is retracted into the handle of the cutting tool.

Figure 7:
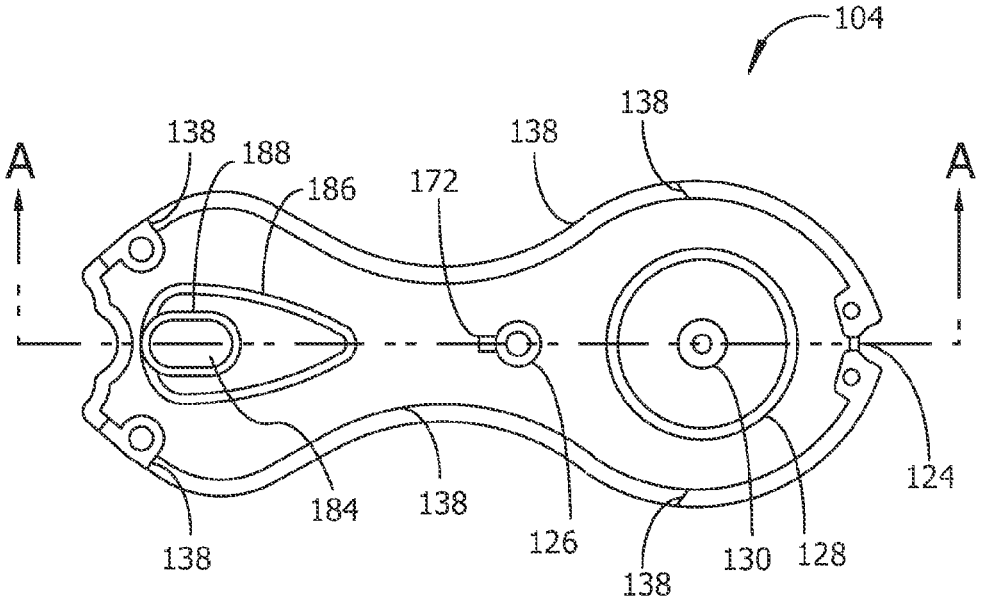
FIG. 7 is a top view of the handle cover, looking toward parts of the handle cover that are concealed inside the handle when the cutting tool is assembled.
Figure 8:
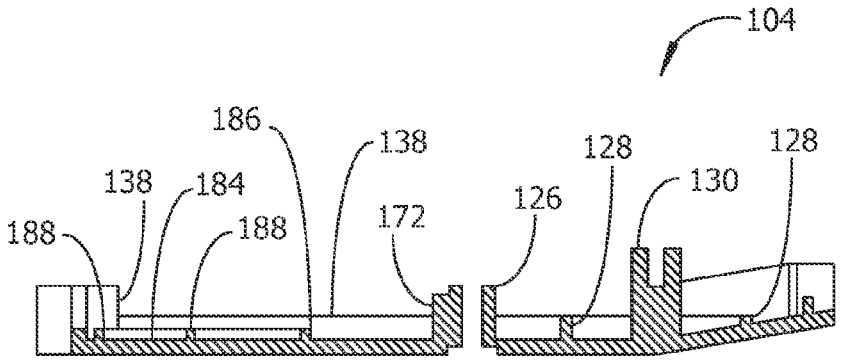
FIG. 8 is a cross-sectional view of the handle cover of FIG. 7.

A tab for engaging the blade locking slots 174 may be joined to an internal surface of the handle, for example a surface in the handle housing or in the handle cover. An example of a handle cover with a blade locking tab is shown in FIGS. 7-8. FIG. 7 is a view toward the inner surface of a handle cover 104, that is, the surface of the cover which would be inside an assembled handle for a cutting tool. FIG. 8 is a cross-sectional view of the handle cover of FIG. 7. A location and viewing direction for the cross section of FIG. 8 is marked by a section line labeled A-A in FIG. 7. The front side of the cutting tool, that is, the side from which the blades extend, is on the left side of FIGS. 7-8. As shown in FIGS. 7-8, a rectangular blade locking tab 172 is attached to a cylindrical cover attachment post 126. A threaded fastener (not shown) may be passed through an aperture in the cover attachment post 126 to attach the handle cover 104 to the handle housing of the cutting tool as in FIGS. 1-2. The blade locking tab 172 has dimensions selected to enable the tab to slidably engage with the two aligned blade locking slots in the blade assembly when the blade assembly is retracted into the handle of the cutting tool.

FIGS. 7-8 illustrate an example of a guide channel for slidably engaging a fastener on a blade assembly. The protruding end of the fastener is constrained to move within the walls of the guide channel when the blade assembly slides out of the handle to deploy the blades and when the blade assembly is retracted into the handle. An example of a guide channel 184 is shown near the front of the handle cover 104. The guide channel 184 is defined by an oblong guide channel ridge 188 which projects upward from the inner surface of the handle cover 104. An additional bearing surface for the blade assembly to slide on is provided by a blade bearing ridge 186 projecting upward from the inner surface of the handle cover 104. The lever arms of the blade assembly extend through slots formed in the sides of the handle and handle cover as previously described. The positions of the slots are indicated by slot edges 138 in FIGS. 7-8. The guide channel may alternatively be located in other parts of the handle, for example an internal surface of the handle housing.

The handle cover 104 includes features for locating a retractable tether mechanism in a cavity formed inside the handle of the cutting tool. A cylindrical pivot post 130 extends upward from the inner surface of the handle cover 104, as shown in FIGS. 7-8. The pivot post 130 serves as an axle around which a spiral spring and a tether reel rotate as will be explained in reference to FIGS. 9-10. A bearing surface for smooth rotation of the tether reel is provided by a raised tether reel support 128 which extends upward from the inner surface of the handle cover 104. The tether is wound around the tether reel and may be pulled out of the handle through a tether aperture 124 on the side of the handle cover. The tether reel and other parts of the tether mechanism may alternately be attached to the handle housing instead of the handle cover.

Figure 10:
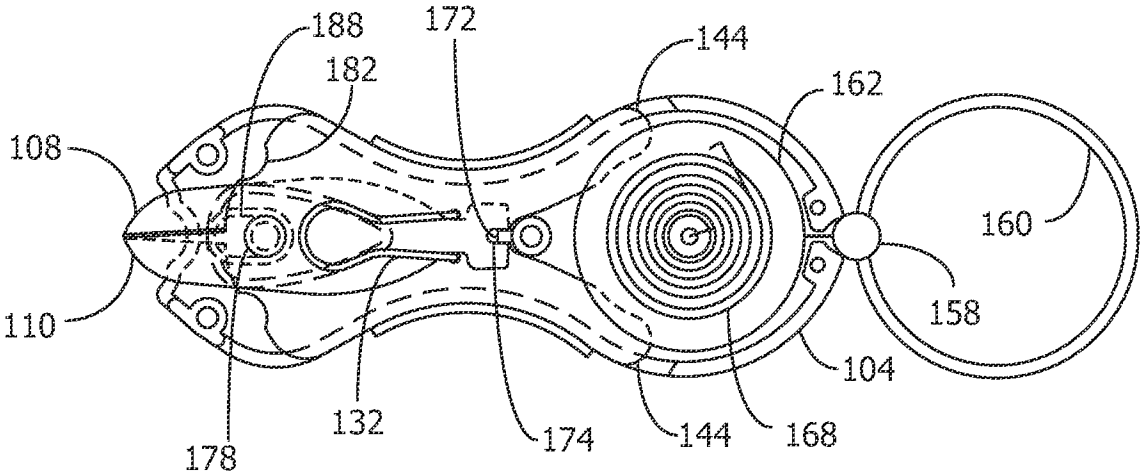
FIG. 10 shows the top view of FIG. 9, with blades, finger grips, lever arms, and tether all retracted into their stowed positions relative to the tool cover.

FIGS. 9-10 show a view of the cutting tool toward the top of the tool with the handle removed to expose the arrangement of the blade assembly, tether reel, and other parts relative to the handle cover. In FIG. 9, the upper and lower blades (108, 110) are extended forward (to the left in the figure) until the edges of the blade limit notches 182 contact parts of the handle cover 104. In the example of FIG. 9, the blade limit notches contact a pair of rounded bosses near the front and sides of the handle cover. With the blades extended forward as shown, the tapered ends 144 of the lever arms are free to spread apart under the action of the blade spring 132, away from the sides of the handle cover 104. With the blades extended fully forward, the protruding end of the fastener 178 on the blade assembly may be seen to be at the front end (left in FIG. 9) of the guide channel defined by the guide channel ridge 188. The end of the fastener 178 engages with the sides of the guide channel ridge 188 with a close sliding fit so that the blades extend and retract smoothly from the cutting tool. The two blade locking slots 174, one in each lever arm, are separated from one another and from the blade locking tab 172 when the blades are extended out from the cutting tool handle housing.

The tether 156 with its tether stop 158 and key ring 160 is shown partially extended from the handle 103 in FIG. 9. The tether 156 is wound around a tether reel 162. A spiral wound spring 168 attached at one end to the tether reel 162 and at another end to the cover attachment post 126 (seen most clearly in FIG. 7) exerts a torque force on the tether reel 162 to cause the tether 156 to retract when the cutting tool or key ring 160 is released by a person using the tool. Withdrawing the tether 156 from the handle winds the spring 168. The spring 168 unwinds as it automatically retracts the tether back onto the tether reel 162.

FIG. 10 continues the example of FIG. 9, but with the blades and tether retracted into their stowed positions. In FIG. 10, the tether is shown fully retracted with the line stop 158 in contact with the back side of the handle cover 104. Most of the tether is wound around the tether reel 162 by the action of the tether reel spring 168 when the tether is retracted. The tapered ends 144 of the upper and lower blades (110, 108) are withdrawn into the handle and the blades are retracted until the end of the fastener 178 on the blade assembly is in contact with the back end (to the right in FIG. 10) of the guide channel formed by the guide channel ridge 188. With the blades closed and retracted, the blade locking slots 174 are aligned vertically one over another, forming an aligned blade locking slot that engages the blade locking tab 172 on the handle cover 104. With the blades and lever arms of the blade assembly in their stowed position, the blade spring 132 may be seen to be in a compressed condition in FIG. 9 compared to its extended condition in FIG. 10.

FIGS. 1 and 2 illustrate how an embodiment of the invention may be deployed, operated, and stowed with one hand. Starting with FIG. 1, sliding the finger grips toward the front side of the tool (to the left in FIG. 1) extends the cutting blades from the handle housing 102 until the blades (108, 110) are fully extended as in FIG. 2. After the blades have been extended and the lever arms extend away from the sides of the handle, squeezing the finger pads 136 of the upper and lower blades (110, 108) together causes the shearing edges of the blades to cross over each other to perform a cut. Releasing finger pressure on the upper and lower lever arms (164, 166) causes the shearing edges and lever arms to open automatically as in FIG. 2. Stowing the blades may be accomplished by simultaneously applying pressure to the finger grips 136 to fully close the blades and sliding the finger grips toward the back side of the handle, that is, toward the tether 156 and key ring 160. The blade assembly is slid back until the blade locking slots in the blade assembly engage the blade locking tab in the handle as explained in reference to FIGS. 9-10. Closing the blades and retracting them into the handle may be accomplished by one continuous motion of a single hand. Reversing the sequence, that is, moving from the condition represented in FIG. 3, then to FIG. 2, and finally to FIG. 1, causes the cutting tool to be moved from a stowed condition to a deployed condition ready for use. Moving from a stowed position to a deployed position may also be performed with one continuous motion of a single hand.

As shown in the figures, each blade is provided with a sharp edge and an end shaped for close, precise trimming. However, when the blades are overlapped and stowed by being partially retracted into the enclosure, the overlapping blades and the end of the handle present a relatively blunt projection. Embodiments of the invention may therefore safely be carried in a pocket or toolbox without the need for a separate carrying case to protect the person carrying the cutting tool, clothing, or other objects in close proximity to the cutting tool, or to protect sharp parts of the cutting tool itself.

Unless expressly stated otherwise herein, ordinary terms have their corresponding ordinary meanings within the respective contexts of their presentations, and ordinary terms of art have their corresponding regular meanings.

What is claimed is:

1. A cutting tool comprising:

a handle comprising:

a handle housing having a first end, a second end opposite said first end, a first side with a slot formed therein, and a second side formed with a slot therein opposite said first side;

a handle cover attached to said handle housing, said handle cover comprising:

an oblong guide channel ridge surrounding a guide channel, wherein said guide channel does not penetrate all the way through any part of said handle; and exactly one blade locking tab positioned between said guide channel and said second end, said blade locking tab extending toward said first end from a cover attachment post attached to said handle cover;

a blade assembly slidably retractable into said first end of said handle, comprising:

a first lever arm fabricated as a single integral part having a first blade, a first tapered end opposite said first blade, and a first arcuate finger grip near said first tapered end;

a second lever arm fabricated as a single integral part having a second blade, a second tapered end opposite said second blade, and a second arcuate finger grip near said second tapered end, said second lever arm rotatably joined to said first lever arm with a fastener having an end slidably engaging said guide channel, said fastener positioned between said first blade and said first finger grip, and said fastener positioned between said second blade and said second finger grip;

a blade locking slot formed in said first lever arm between said fastener and said first tapered end;

a blade locking slot formed in said second lever arm between said fastener and said second tapered end; and a spring coupled to said first and second lever arms;

a stowed position of said blade assembly, comprising:

said first and second tapered ends and said first and second finger grips displaced toward one another and toward said second end of said handle until said blade locking slot on said first lever arm and said blade locking slot on said second lever arm both engage said blade locking tab, thereby holding said first and second blades in a closed position partially retracted into said handle;

said first tapered end disposed in said handle through said slot formed in said first side; and said second tapered end disposed in said handle through said slot formed in said second side; and a deployed position of said blade assembly, comprising:

said first and second tapered ends and said first and second finger grips slidably displaced toward said first end of said handle until said blade locking slots on said first and second lever arms disengage from said blade locking tab;

said first tapered end extending outward from said first side of said handle through said slot formed in said first side; and said second tapered end extending outward from said second side of said handle through said slot formed in said second side.

2. The cutting tool of claim 1, further comprising an automatically retracting tether extendable from said handle.

3. The cutting tool of claim 2, further comprising:

said handle further comprising a tether reel post;

a tether reel rotatably coupled to said tether reel post; and a spiral wound spring attached to said tether reel post and to said tether reel.

4. The cutting tool of claim 3, wherein said tether is wound around said tether reel, said tether is unwound from said tether reel by withdrawing said tether from said handle, and releasing said tether causes said spiral wound spring to wind said tether around said tether reel.

5. A cutting tool, comprising:

a handle, comprising:

a first end;

a guide channel adapted for a sliding fit of an end of a fastener; and exactly one blade locking tab positioned between said guide channel and a second end of said handle opposite said first end;

a blade assembly slidably retractable toward said second end of said handle, said blade assembly comprising:

a first lever arm fabricated as a single integral part having a blade and a tapered end opposite said blade;

a second lever arm fabricated as a single integral part rotatably joined to said first lever arm by said fastener with said fastener positioned between said blade and a finger grip on said first lever arm, between said blade and another finger grip on said second lever arm, and with said end of said fastener slidably engaging said guide channel;

a blade locking slot formed in said first lever arm between said fastener and said tapered end of said first lever arm;

a blade locking slot formed in said second lever arm between said fastener and said tapered end of said second lever arm; and a spring coupled to said first and second lever arms, said spring urging said tapered end of said first lever arm away from said tapered end of said second lever arm; and a stowed position of said blade assembly, comprising said tapered ends of said first and second lever arms displaced toward one another and toward said second end of said handle until said blade locking tab slides into both of said blade locking slot on said first lever arm and said blade locking slot on said second lever arm.

6. The cutting tool of claim 5, further comprising:

said handle comprising a first side joined to said first end and a second side joined to said first end opposite said first side;

said first side of said handle formed with a slot sized for passage of said first lever arm from said fastener to said tapered end of said first lever arm;

said second side of said handle formed with a slot sized for passage of said second lever arm from said fastener to said tapered end of said second lever arm; and said stowed position further comprising:

said tapered end of said first lever arm disposed in said handle through said slot formed in said first side; and said tapered end of said second lever arm disposed in said handle through said slot formed in said second side.

7. The cutting tool of claim 5, further comprising a deployed position of said blade assembly, comprising:

said tapered ends of said first and second lever arms slidably displaced toward said first end of said handle until said blade locking slots on said first and second lever arms disengage from said blade locking tab;

said tapered end of said first lever arm extending outward from said first said of said handle through said slot formed in said first side; and said tapered end of said second lever arm extending outward from said second side of said handle through said slot formed in said second side.

8. The cutting tool of claim 5, wherein said spring couples to said first lever arm between said fastener and said tapered end of said lever arm.

9. The cutting tool of claim 5, further comprising a tether reel rotatably coupled to said handle between said blade locking tab and said second end of said handle.

* * * * *